US006940991B2

(12) United States Patent
Shingu

(10) Patent No.: US 6,940,991 B2
(45) Date of Patent: Sep. 6, 2005

(54) DAMPER FOR LOUDSPEAKER AND METHOD FOR MANUFACTURING SAME

(75) Inventor: Fumiteru Shingu, Akishima (JP)

(73) Assignee: Foster Electric Co., Tokyo (JP)

( * ) Notice: Subject to any disclaimer, the term of this patent is extended or adjusted under 35 U.S.C. 154(b) by 120 days.

(21) Appl. No.: 10/044,018

(22) Filed: Jan. 10, 2002

(65) Prior Publication Data

US 2002/0094106 A1 Jul. 18, 2002

(30) Foreign Application Priority Data

Jan. 18, 2001 (JP) ..... 2001-009624

(51) Int. Cl.[7] ..... H04R 25/00
(52) U.S. Cl. ..... 381/404; 381/409; 381/410
(58) Field of Search ..... 381/398, 400, 381/404, 407–410, 426, 396, 399, 401, 403; 29/594, 609.1

(56) References Cited

U.S. PATENT DOCUMENTS 4,376,233 A * 3/1983 Kamon et al. ..... 381/409
5,191,697 A * 3/1993 Sakamoto et al. ..... 29/594
5,249,236 A * 9/1993 Sakamoto ..... 381/409

FOREIGN PATENT DOCUMENTS

| | | | |
|---|---|---|---|
| EP | 0 479 317 A2 | | 4/1992 |
| JP | 62-216819 | | 3/1989 |
| JP | 03259699 A | | 11/1991 |
| JP | 10-336788 | * | 12/1998 |
| JP | 2000-41296 | * | 2/2000 |

* cited by examiner

*Primary Examiner*—Suhan Ni
(74) *Attorney, Agent, or Firm*—Lynn & Lynn

(57) ABSTRACT

A damper for loudspeaker is constituted by mounting tubular knitted tinsel cords through an adhesive agent of acrylic emulsions having a tackiness onto one surface of a corrugated damper body. The damper is thereby rendered easily manufacturable and highly flexible enough for restraining any breaking of the tinsel cords and improving the reliability.

3 Claims, 3 Drawing Sheets

FIG. 3a
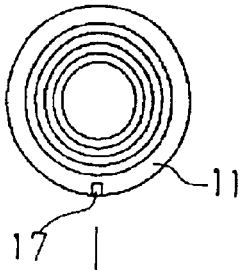
FIG. 3b
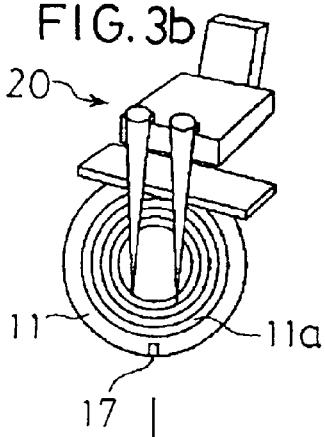
FIG. 3c
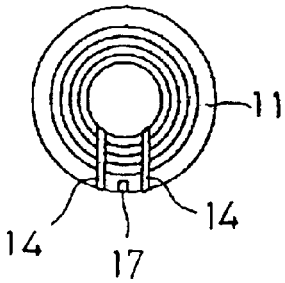
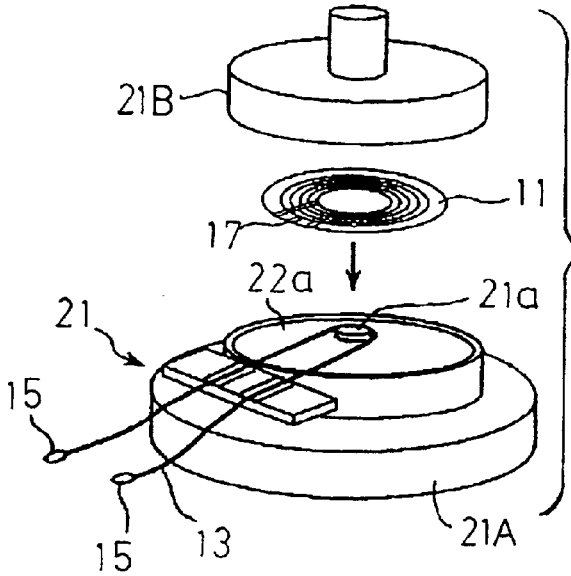
FIG. 3d
FIG. 3e
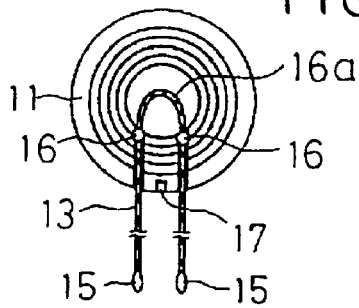
FIG. 3f
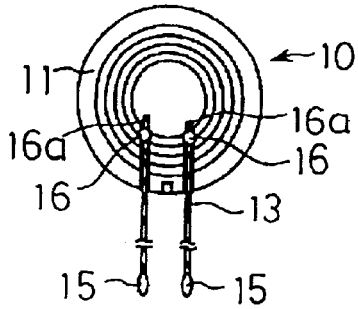

DAMPER FOR LOUDSPEAKER AND METHOD FOR MANUFACTURING SAME

TECHNICAL FIELD OF THE INVENTION

This invention relates to dampers used as a constituting member of loudspeakers employed in various acoustic devices and equipments or, more specifically, to a damper for loudspeakers which is called as a conductive damper with tinsel cords mounted on a surface thereof, and to a method for manufacturing such damper.

DESCRIPTION OF RELATED ART

Generally, voice coils of the loudspeaker are supported by a frame through the damper for vibration, and lead wires of the voice coils are connected through the tinsel cords to input terminals of the loudspeaker. Since the tinsel cords are generally disposed in a space between a diaphragm and the damper, there has been a problem that the tinsel cords are caused to move rockingly during the operation of the loudspeaker so as to hit the diaphragm or damper and generate an abnormal noise and so on, and this tendency has been increased to be more remarkable as the loud speaker is developed to be more minimized and thinner in the dimensions.

In order to solve this problem, there has been suggested a damper in which the tinsel cords are made integral with the damper by means of an adhesion or a sewing-up, as has been disclosed in, for example, Japanese Patent Laid-Open Publications Nos. 10-336788 and 2000-41296, in the former of which the tinsel cords employed are of thin and plain woven ones held onto one surface of the damper body by means of heat fusion of a strip-shaped polyurethane member, while in the latter of which a tubular-knitted tinsel cord stronger and less damageable than the plain-woven one upon heat compression is used as bonded with polyurethane layer interposed. It has been also possible to bond the tinsel cords onto the damper body with an adhesive agent of silicones employed.

However, in the case where such plain-woven tinsel cord is used as has been disclosed in the former Publication 10-336788, there has been a problem that, upon being soldered, a very small thickness of the wire causes the solder to leach out and the soldering has been made complicated. While in the case of such tubular knitted tinsel cords as employed in the latter Publication 2000-41296 the soldering is not caused to become so complicated, the manufacturing has been complicated, including the case of the former Publication 10-336788, due to that the polyurethane member is required to be peeled off at a portion inside the tinsel cords disposed adjacent to an inner aperture of the damper body. Yet, as the tinsel cord has no extensibility, it cannot be bonded along the wave of corrugations of the damper body so that there arises a risk of causing the solder foil to be flawed and damaged with any excessive force applied forcibly for matching with the corrugations, an exclusive-use molding dies are required, and there has been a problem that the manufacture as a whole has been complicated.

Further, in the case of the mounting of the tinsel cords with the adhesive agent of silicones employed, there has been another problem that the adhesive agent soaks into stitches of the cords so as to cause a risk of breaking the cords as hardened with the soaked agent cured, so as to lower the reliability, and to disturb required displacement of the damper. Since the tinsel cords are secured to the surface of the damper as made integral therewith, further, it has been unable to closely bond the tinsel cords to the damper body along the corrugations from the inner end to the outer end thereof, and there has been a risk of damaging the cords due to that the tinsel cords are shortened so as to be unable to move following the vibration of the damper body but to apply an excessive tension to the tinsel cords.

TECHNICAL FIELD

It is an object of the present invention to overcome the foregoing problems in the prior art; to provide a damper for the loudspeakers which is made easier to manufacture, high in the flexibility to be assured in free operation as the damper, and improved in the reliability with damage of the tinsel cords restrained; and to provide a method for manufacturing such damper.

According to the present invention, the above object can be established by means of provision of a damper for the loudspeakers in which tubular knitted tinsel cords are bonded to one surface of a body of the damper provided with corrugations through an adhesive agent of acrylic emulsions having a tackiness interposed.

Other objects and advantages of the present invention shall become clear as the following description of embodiments of the invention advances with reference to accompanying drawings showing the respective embodiments.

BRIEF DESCRIPTION OF THE DRAWINGS

FIGS. 3*a* to 3*f* are explanatory views for manufacturing steps of the damper in an embodiment according to the present invention.

While the present invention shall now be described in the followings with reference to the embodiments shown in the accompanying drawings, it should be appreciated that the intention is not to limit the invention only to the embodiments shown but rather to include all alterations, modifications and equivalent arrangements possible within the scope of appended claims.

DESCRIPTION OF PREFERRED EMBODIMENTS

Figure 1:
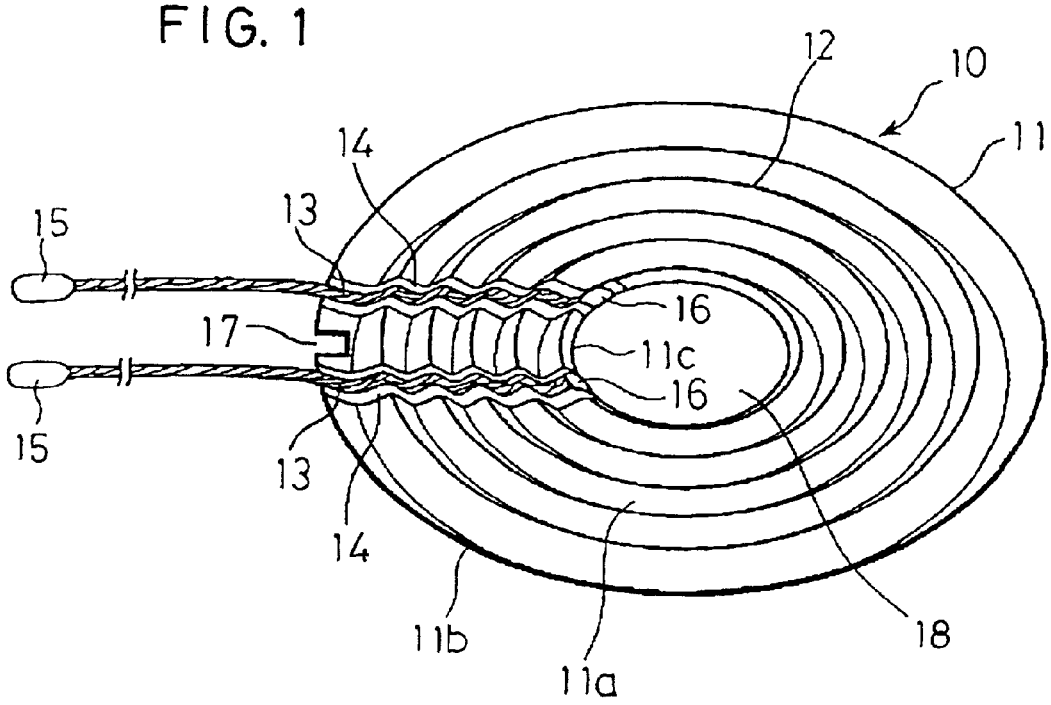
FIG. 1 is a perspective view of the damper in an embodiment of the present invention.

Referring to FIG. 1, there is shown a damper for loudspeakers in an embodiment according to the present invention, in which the damper 10 comprises a body 11 formed in a ring shape having a plurality of corrugations 12 of concentric circles. A pair of tubular knitted tinsel cords 13 are provided as bonded in strip shape on one surface 11*a* of the damper body 11 to lie along the shape of the corrugations 12, with a layer of adhesive agent 14 interposed, from outer peripheral edge 11*b* to inner peripheral edge 11*c*. Outer ends of these tubular knitted tinsel cords 13 extend outward and are provided at tip ends with soldered parts 15. As has been well known, these soldered parts 15 are connected to relay terminals (not shown) of the loudspeaker. Inner ends of the wires are also provided with soldered parts 16 which are connected to lead wires (not shown) of voice coils on a coil bobbin, as also well known. The damper body 11 is provided at outer periphery with a positioning notch 17 for use upon bonding of the tubular knitted tinsel cord 13 employed in this case is formed by winding copper foils of a copper wire rolled to be less than ¼ of the generant diameter less than 0.10 mm around meta-series alamid fibers of single or twin woven center thread of 40 count into a tinsel, and assembling 4 to 16 tinsels into a cord at a weaving pitch of 20±5/turn, so as to be of a structure less damageable upon being subjected to the heat under pressure. With such assembling of the wires at a coarse weaving pitch, the tubular woven tinsel cord 13 is made to be less breakable upon being worked under pressure but readily crushable to be easily flattened, so that the adhesion properties between molding die gap and the damper body upon molding can be improved and the configure of the corrugations 12 can be stabilized so as not to impair inherent properties of the damper body 11. Further, since the tubular knitted tinsel cords 13 employed are small in the thickness, the cords 13 are improved in the bending properties with respect to the vibration, so as to be also improved in the durability.

In addition to such bendability because of the special structure of the tinsel cords 13 tubular woven, the cords 13 and damper body 11 are coupled in flexible manner through the adhesive agent 14 having the tackiness, whereby the damper body 11 is further improved in the freedom of motion, with the effect of preventing the breakage of the tinsel cords 13 also improved.

Figure 2:
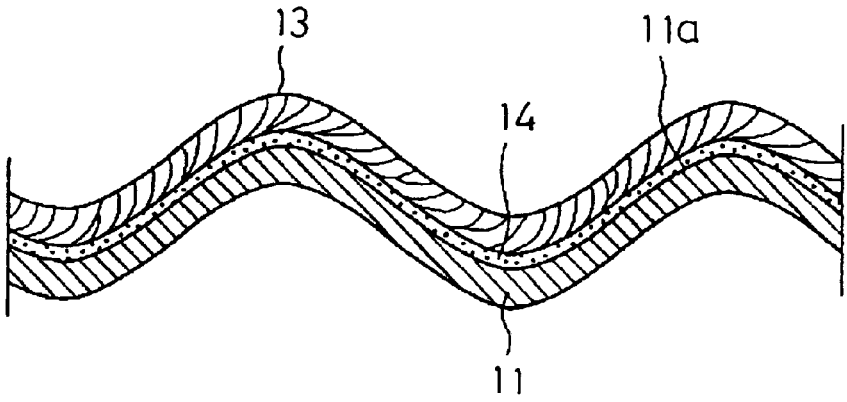
FIG. 2 is a fragmentary sectioned view as magnified of the damper in FIG. 1.

In FIG. 2, there is shown the structure in which the tubular knitted tinsel cords 13 are coupled through the adhesive agent 14 onto the damper body 11. In assembling this structure, the adhesive agent 14 having the tackiness is applied in a strip shape from the inner peripheral edge to the outer peripheral edge on the one surface 11*a* of the body 11, and the tubular knitted tinsel cords 13 are placed over the strip of the agent 14 to be bonded to the damper body 11. Even when the adhesive agent 14 strikes through the tubular knitted tinsel cords 13, the agent 14 can maintain its tackiness so that the tubular knitted tinsel cords 13 can be kept not to be hardened by the adhesive agent. For this adhesive agent 14, a product named BOND 7 (by SUMITOMO-3M) of an adhesive agent of acrylic emulsions can be effectively used. This adhesive agent 14 does not lower its adhesivity even after being dried, so as to be of viscoelastic type which maintaining the tackiness.

When the damper 10 operates with the voice coils for the vibration of the diaphragm, therefore, the adhesive agent 14 does not disturb the operation but rather acts as a cushion for the tubular knitted tinsel cords 13, so as to improve the freedom of the operation of the damper 10 in cooperation with the excellent bendability of the tubular knitted tinsel cords 13, without any influence on the dynamic properties of the diaphragm eventually, while preventing the tubular knitted tinsel cords 13 from being broken.

FIGS. 3*a* to 3*f* show respective steps of bonding the tubular knitted tinsel cords 13 onto the damper 10, wherein manufacturing steps of the body 11 of the damper 10 are of known art generally adopted and detailed description thereof shall be omitted here.

First, as shown in FIG. 3*a*, the damper body 11 is provided with a notch 17 as a positioning guide, at an outer peripheral part used as an adhering margin to a frame or the like part of the loudspeaker. For the shape of this notch 17, any proper one of square and round bottomed U-shape and an arcuate shape can be adopted. The notch 17 is used as a positioning mark at a bonding step of the tubular knitted tinsel cords 13 with respect to the damper body 11, in the intention of improving the positioning precision and the workability. Then, as shown in FIG. 3*b*, the damper body 11 is disposed at a predetermined position on a working station by means of the notch 17. At the position where the damper body 11 is disposed, a projection or the like (not shown) fittable in the notch 17 is provided, and the positioning may be made by engaging the notch 17 to the projection upon the disposition of the body. The adhesive agent 14 is then applied to predetermined zones on the one surface 11*a* of the body 11 by means of a biaxial coating robot 20. A proper amount of the adhesive agent 14 can be applied uniformly onto the corrugations 12 therealong, without being applied excessively to fill up grooves in the corrugations. While the biaxial coating robot 20 has been referred to as means for applying the adhesive agent 14, the invention is not limited thereto but any other proper means may be employed.

The damper body 11 coated with the adhesive agent 14 at two zones substantially parallel with each other as shown in FIG. 3*c* is left to stand for a predetermined period to dry the agent.

As shown in FIG. 3*d*, the tubular knitted tinsel cord 13 cut into a predetermined length at every disposition and having soldered parts 15 at both ends is placed on a combining molding die 21 as folded back at the central portion hung around a center hook 21*a* of the die 21 to lie substantially in parallel. The combining molding die 21 comprises a base die 21A including a damper mounting part 22*a* having the center hook 21*a*, and a pressure mold 21B disposed on the base die 21A, the damper body 11 is mounted on the damper mounting part 22*a* configured substantially the same as the damper body 11, with the one surface 11*a* faced to the mounting part 22*a* and with the notch 17 positioned between the parallel folded back portions of the tinsel cord 13, and the body 11 is pressed against the cord 13 by means of the pressure mold 21B. At this pressing step, no heat is applied, and it is possible to restrain the adhesive agent 14 from being fused to adhere to the die 21A so as to contaminate therearound.

Then the damper body 11 to which the folded-back tinsel cord 13 is bonded, as shown in FIG. 3*e*, is released from the die 21, soldered parts 16 are provided to the tinsel cord 13 at positions along the inner peripheral edge of the body 11, and an excess central folded-back portion 16*a* of the cord outside the soldered parts 16 is cut off. In cutting the excess portion 16*a*, as shown in FIG. 3*f*, certain extent of the portion out of the soldered parts 16 may be left or the portion may be completely removed.

Figure 4A:
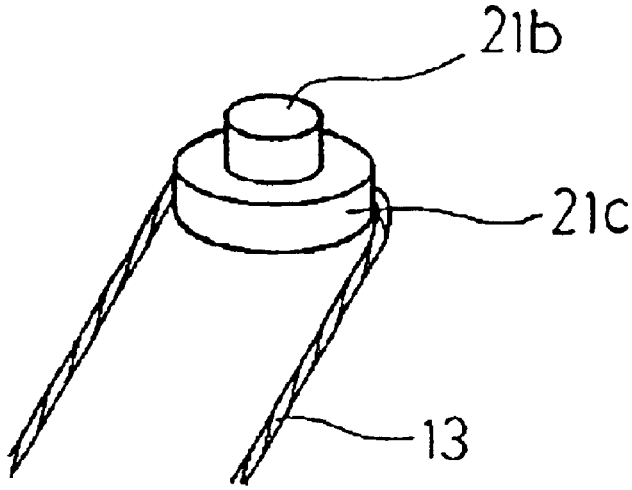
FIGS. 4*a* and 4*b* are explanatory views for hook means in a molding die employed in the manufacturing steps of the method according to the present invention.
Figure 4B:
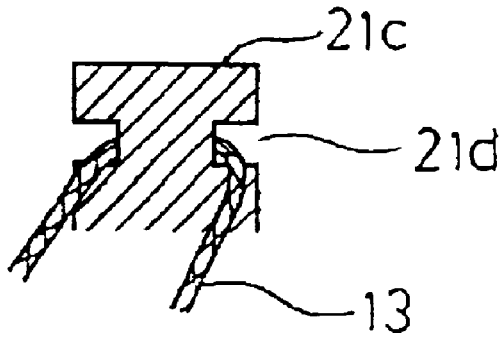

FIG. 4*a* shows another embodiment of the center hook 21*a* of the molding die 21A, in which the tubular knitted tinsel cord 13 is hung around outer periphery of a disk-shaped part 21*c* having a short columnar part 21*b*, and the disk-shaped part 21*c* has an outer configuration fittable into the aperture 18 of the damper body 11 (FIG. 1). FIG. 4*b* shows a further embodiment of the hook, in which a columnar part has in outer periphery thereof a guide groove 21*d* for hanging therein the tubular knitted tinsel cord 13, so that the cord can be prevented from being deviated.

What is claimed is:

1. A damper for loudspeakers comprising:

a damper body having corrugations;

an adhesive agent of acrylic emulsions applied to a plurality of portions of one surface of the damper body, the adhesive agent having tackiness and maintaining a viscoelasticity even after being dried; and a plurality of tubular knitted tinsel cords bonded to the plurality of portions of the damper body through the adhesive agent wherein the tubular knitted tinsel cords are sin a state of having been flattened and bonded to the adhesive agent on the damper body only by apply a pressure thereto; and wherein the adhesive agent acts a cushion between the damper and the tubular knitted tinsel cords even after being dried.

2. The damper for loudspeakers according to claim 1 wherein the tubular knitted tinsel cords comprise an assembly of4 to 16 tinsels, respectively, of a center thread of one of meta-series alamid fibers of single woven thread of 40 count and a copper foil made by a copper wire rolled to be less than ¼ of a generant of a diameter less than 0.10 mm, the foil being wound on the center thread, and the tinsel being knitted at a coarse weaving pitch of 20±5 mm/turn into the tubular knitted tinsel cord of a structure less subject to damage upon application of a pressure thereto.

3. The damper for loudspeakers according to claim 1 wherein the tubular knitted tinsel cords comprise an assembly of 4 to 16 tinsels respectively of a center thread of one of meta-series alamid fibers of twin woven thread of 40 count and a copper foil made by a copper wire rolled to be less than ¼ of a generant of a diameter less than 0.10 mm, the foil being wound on the center thread, and the tinsel being knitted at a coarse weaving pitch of 20±5 mm/turn into the tubular knitted tinsel cord of a structure less damageable under a pressure.

* * * * *